US006599567B2

(12) United States Patent
Whitehorn

(10) Patent No.: US 6,599,567 B2
(45) Date of Patent: Jul. 29, 2003

(54) METHOD FOR GLITTER COATING A CYLINDRICAL ARTICLE

(75) Inventor: William P. Whitehorn, Yardley, PA (US)

(73) Assignee: Rose Art Industries, Inc., Livingston, NJ (US)

( * ) Notice: Subject to any disclaimer, the term of this patent is extended or adjusted under 35 U.S.C. 154(b) by 0 days.

(21) Appl. No.: 10/029,069

(22) Filed: Dec. 20, 2001

(65) Prior Publication Data

US 2003/0118721 A1 Jun. 26, 2003

(51) Int. Cl.[7] ..... B05D 1/12; B05D 1/38

(52) U.S. Cl. ..... 427/202; 427/205; 427/345; 427/369

(58) Field of Search ..... 427/180, 185, 427/202, 203, 205, 345, 356, 358, 369, 440, 443.2; 118/125, DIG. 11, 18; 401/42, 52, 195

(56) References Cited

U.S. PATENT DOCUMENTS

| | | | |
|---|---|---|---|
| 3,291,630 A | * | 12/1966 | Deyle et al. |
| 4,490,415 A | * | 12/1984 | Imamura et al. |
| 5,735,622 A | | 4/1998 | Melnick et al. |
| 6,048,422 A | | 4/2000 | Kim et al. |
| 6,217,245 B1 | | 4/2001 | El-Fakir et al. |

* cited by examiner

*Primary Examiner*—Fred J. Parker
(74) *Attorney, Agent, or Firm*—McCarter & English, LLP; Allen N. Friedman, Esq.; Christine Johnson, Esq.

(57) ABSTRACT

Glitter is applied to cylindrical articles by forcing them through a pot of clear lacquer, squeegeeing the coating to a desired thickness by means of an elastic elastomeric grommet, and then immediately passing the articles through a pot of glitter. The articles then pass through a vacuum tube, which removes the excess glitter for reuse.

7 Claims, 3 Drawing Sheets

METHOD FOR GLITTER COATING A CYLINDRICAL ARTICLE

GOVERNMENT FUNDED RESEARCH

Not applicable

BACKGROUND OF THE INVENTION

1. Field of the Invention

The invention is in the field of the application of decorative coatings to small articles, such as pencils and other writing implements.

2. Brief Description of the Background Art

Cylindrical articles, such as pencils, to which the present invention applies, have been coated with decorative coatings by methods such as, dipping, spraying, and by forcing the articles through a pot of coating liquid and squeegeeing off excess liquid, followed by a drying or curing step. See, for example; U.S. Pat. No. 5,735,622, which also discloses use of multiple coatings to achieve a desired decorative or tactile objective. Application of decorative glitter to an irregular object by a method including vibrating the object is disclosed in U.S. Pat. No. 6,048,422. And deposition of glitter on cylindrical writing instruments by an electro-flocking process involving application of an electrostatic voltage between the writing instrument and the glitter dispenser is disclosed in U.S. Pat. No. 6,217,245.

The instant application discloses a novel, economical method of producing a cylindrical article, such as a pencil, with a decorative glitter coating.

BRIEF DESCRIPTION OF THE INVENTION

In the herein disclosed process, glitter is applied to a succession of cylindrical articles by forcing them through a pot of clear lacquer, squeegeeing the coating to a desired thickness, and then immediately passing the article through a pot of glitter. The articles then pass through a vacuum tube, which removes the excess glitter for reuse. The glitter particles swirling in the tube also tend to adhere to any areas of exposed lacquer. The articles are then dropped onto a conveyor that is long enough to permit them to dry before being collected for curing and subsequent processing. The glitter-coated articles are then forced through a pot of clear lacquer and a squeegeeing grommet for application of one or more seal coats. This process can be automated quite economically.

DETAILED DESCRIPTION OF THE INVENTION

Figure 1:
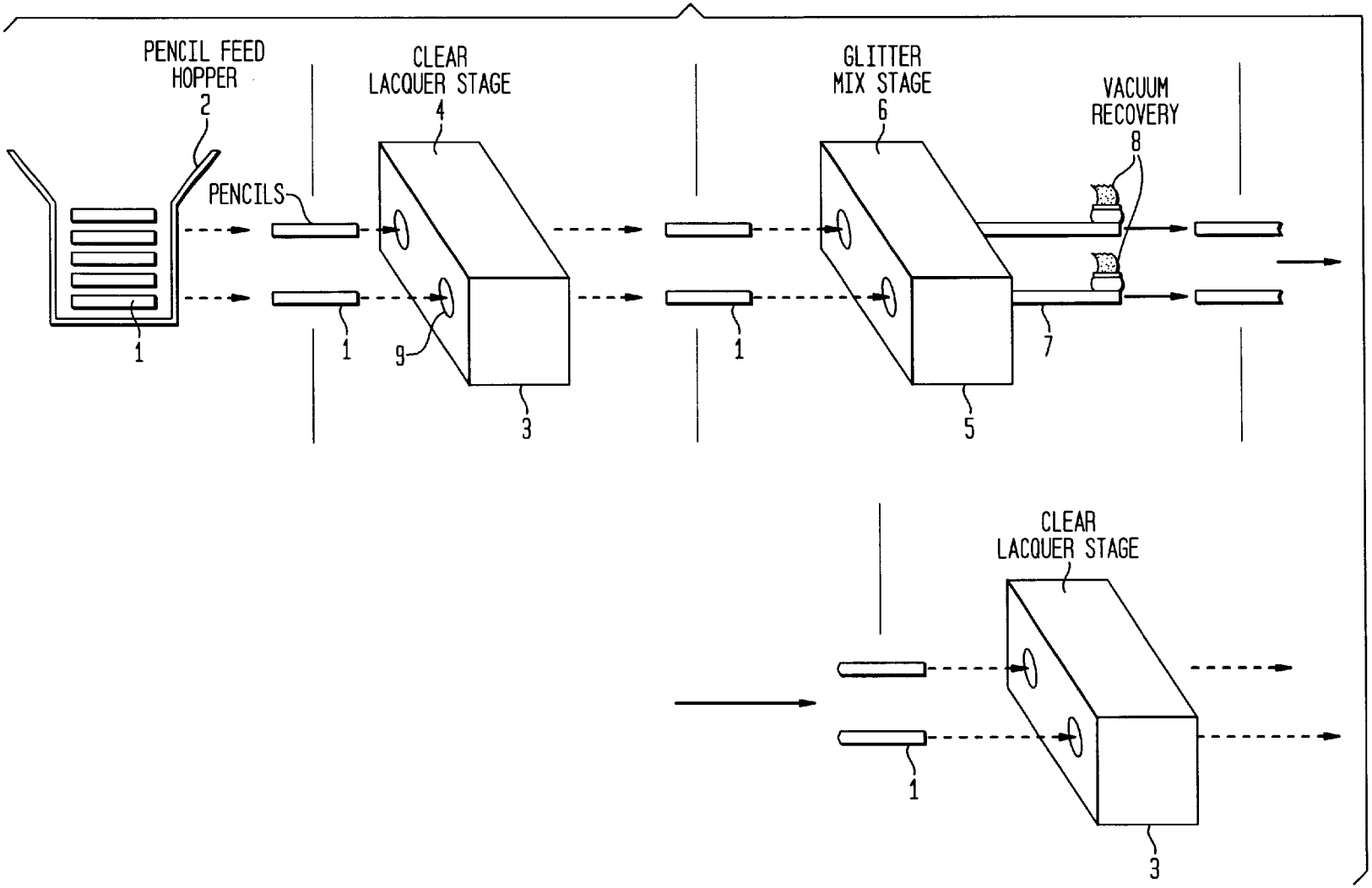
FIG. 1 is a schematic view of the successive steps of the inventive process.

In an illustrative example of the inventive process, pencils (1) are gravity fed from a hopper (2) onto a grooved conveyor and pushed through a pot (3) of clear lacquer (4). The pencils (1), are then forced through an adjoining pot (5) filled with glitter (6). The pencils then pass through a glitter recovery tube (7) to which vacuum hoses (8) are attached, to collect free glitter that passes out of the glitter pot (3) with the glitter-coated pencils. The air drawn by the vacuum hoses (8) also causes the glitter to swirl around in the recovery tubes (7) and adheres to any uncoated lacquer patches.

After the lacquer on the glitter coated pencils has had a chance to cure, the pencils are passed one or more times through a pot of clear lacquer to provide a sealing coat. Curing times of the order of 12 to 24 hours are advantageous. However, the curing process can be accelerated by heating.

The glitter used in the exemplary process is a coated MYLAR® sheet cut to 0.008 inch hexagonal pieces. The lacquer is a quick-drying viscous product. The viscosity is selected such that the lacquer does not leak out of the entry port (9) of the lacquer pot (3) as the pencils are pushed through the apparatus. A lacquer of viscosity of approximately 39,000 to 42,000 cps. as measured using a Brookfield #4 spindle rotating at 6 RPM, has been found to be useful in an exemplary apparatus. The lacquer is a common industrial lacquer referred to as a clear gloss gasket lacquer.

Prior to application of glitter, it is usually advantageous to apply a colored lacquer coating to the bare wood pencil blanks. This colored coating, together with the iridescence supplied by the glitter gives the pencil its attractive finished appearance.

Figure 2:
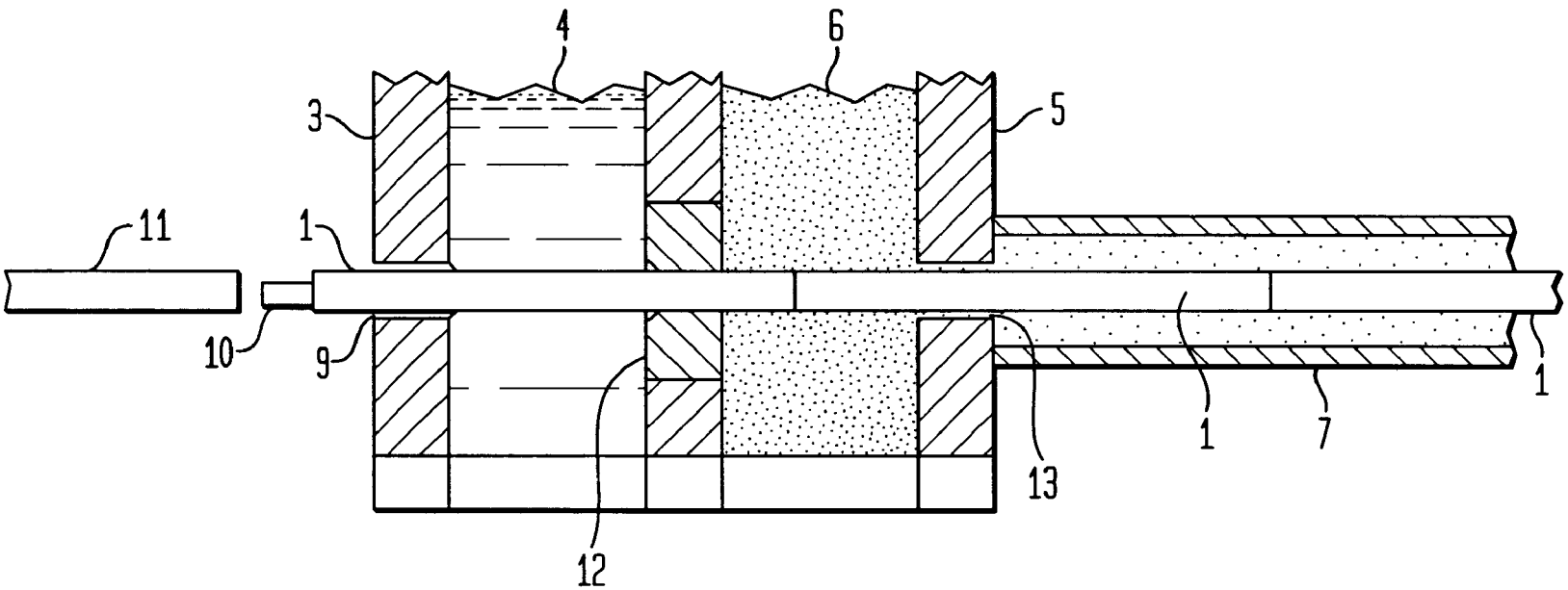
FIG. 2 is an elevational view in section illustrating critical portions of the inventive process.

FIG. 2 shows a succession of pencils (1) being pushed successively through lacquer (4) and glitter (6). The pencils (1) are impelled by a succession of lugs (10) affixed to an endless chain (not shown). Each pencil (1) pushes the one in front of it and a pencil (11) drops down by gravity behind the lug (10). As the lug (10) is retracted by the endless chain, the next succeeding lug (10) advances behind the newly fed pencil (11) and advances it to push against the preceding pencils (1).

The entry port (9) into the lacquer pot (3) is a clearance hole, slightly larger than the pencil (1). The diameter of the entry port (9) is selected to be large enough not to interfere with passage of the pencils (1) and small enough to prevent significant leakage of lacquer. As an example of useful dimensions, an entry port (9) of 0.380 inches has been used in conjunction with pencils that are 0.290 inches in diameter. Cylindrical pencils of both round and hexagonal cross section have been coated in an exemplary coating machine.

Between the lacquer pot (3) and the glitter pot (5) the pencils (1) pass through a gasket or grommet (12) that serves to squeegee the lacquer to the desired coating thickness. The grommet (12) is made of an elastomer, such as a rubber or NEOPRENE® that is stable against the solvents in the lacquer. The size of the opening is less than the diameter of the cylindrical article, to provide the necessary wiping (squeegeeing) action and prevent leakage of lacquer (4) into the glitter pot (5). The size of the opening is dependent on the degree of elasticity of the grommet material and the viscosity of the lacquer and can be determined by routine experimentation. However, for the exemplary 0.290 inch diameter pencils, grommet openings of approximately 0.230 inches have been used successfully to apply the clear seal coat and in the range 0.285 inches to 0.290 inches before passing the pencils (1) through the glitter (6). It has been found that some glitters are more powdery than others and require a somewhat heavier lacquer coat for sufficient adherence. A short conical entry section into the opening of the deformagle grommet (12) is advantageous in leading the pencil (1) into the opening.

The opening (13) between the glitter pot (5) and the glitter recovery tube (7) should, preferably be larger to prevent jamming of the stream of pencils (1) Exit openings (13) up to approximately 0.75 inches have been used. Such an opening size permits a quantity of glitter (6) to pass through with the pencils (1). This glitter swirls around in the glitter recovery tube (7) and is sucked through vacuum hoses (8) into the glitter recovery system (14).

Figure 3:
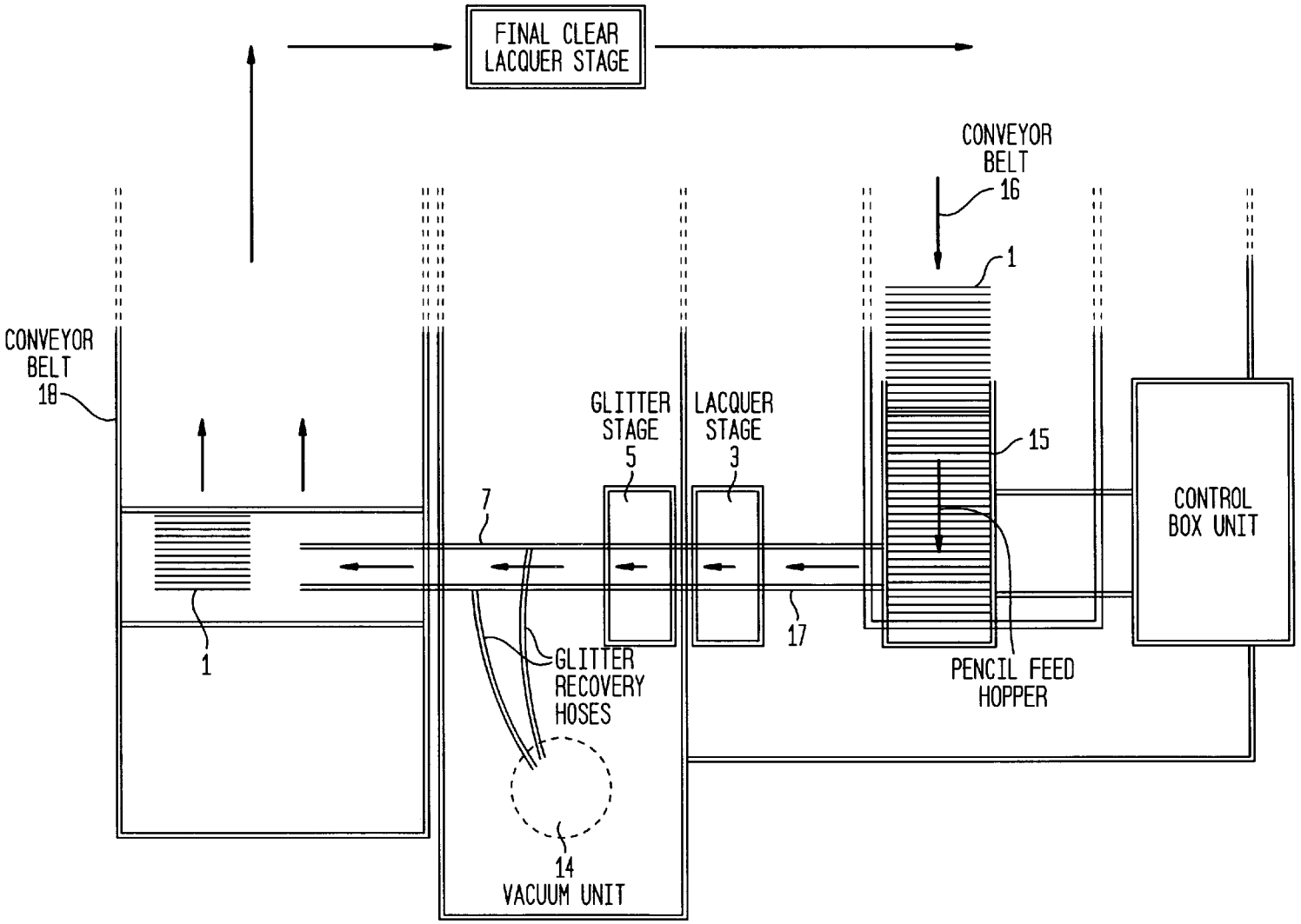
FIG. 3 is a schematic view of an exemplary apparatus implementing the inventive process.

FIG. 3 is a representational view of an exemplary glitter coating apparatus. Pencils (1) are fed into a hopper (15) manually or by a conveyor belt (16), falling successively onto a feeding groove (17). They are impelled by a series of lugs (10) through a lacquer pot (3) and a glitter pot (5). These can be two sections of one container as shown in FIG. 2, or as two separate pots of FIG. 3. Use of two separate pots facilitates cleaning and permits easy change of glitter color. Removal of the glitter pot permits the same apparatus to apply a colored coating prior to applying glitter, and a clear coating after applying glitter.

From the glitter pot (5), the pencils (1) pass through the glitter recovery tube (7) where the excess glitter is removed through vacuum hoses (8) and pass into the glitter recovery system (14). The pencils (1) then fall onto a moving conveyor belt for curing and collection. The length of the conveyor belt is selected such that the pencils remain for an initial cure time suficiently long that they can be gathered at the end of the belt without sticking together. After curing, the pencils (1) are passed through the apparatus again for application of one or more clear seal coats of lacquer.

What is claimed is:

1. A method of applying a decorative glitter coating to a succession of cylindrical objects, comprising:

a) propelling the objects through a quantity of lacquer in a first pot;

b) then propelling the objects through a deformable elastomeric grommet with an aperture smaller than the objects' dimension by an amount sufficient to squeegee the lacquer to a coating thickness to provide sufficient adherence to the subsequently applied decorative glitter coating thereby producing lacquer coated objects; and c) then propelling the lacquer coated objects through a second pot filled with glitter particles, whereby glitter adheres to the lacquer coated objects, providing the decorative glitter coating, thereby forming glitter-coated objects.

2. The method of claim 1 further comprising propelling the glitter-coated objects from the second pot, through an exit orifice into a glitter recovery tube, through which tube air and excess glitter whirl around the glitter-coated objects and the air and excess glitter are drawn through vacuum hoses into a glitter recovery device.

3. The method of claim 2 further comprising propelling the glitter-coated objects from the glitter recovery tube onto a moving conveyor, on which conveyor the glitter-coated objects reside for an initial curing time, thereby permitting the glitter-coated objects to be gathered together without sticking.

4. The method of claim 3 further comprising curing the glitter-coated objects that are gathered for a second curing time.

5. The method of claim 4 further comprising propelling the glitter-coated objects through the first chamber and the elastomeric grommet whereby the glitter-coated objects acquire a coating of clear lacquer that seals the glitter to the glitter-coated objects.

6. The method of claim 1 further comprising propelling the succession of cylindrical objects such that each object propels the preceding object.

7. The method of claim 6 further comprising propelling the succession of cylindrical objects by engaging the rear-most object with a moving lug.

* * * * *